US009391404B2

(12) United States Patent
Shimizu et al.

(10) Patent No.: US 9,391,404 B2
(45) Date of Patent: Jul. 12, 2016

(54) LEVER-OPERATIVE CONNECTOR

(71) Applicant: Yazaki Corporation, Tokyo (JP)

(72) Inventors: Tomohiko Shimizu, Makinohara (JP); Akinori Tashiro, Makinohara (JP); Akihiro Tsuruta, Fujieda (JP); Kazuya Terao, Fujieda (JP); Hiroshi Kobayashi, Toyota (JP); Masao Nagano, Toyota (JP)

(73) Assignee: Yazaki Corporation, Tokyo (JP)

( * ) Notice: Subject to any disclaimer, the term of this patent is extended or adjusted under 35 U.S.C. 154(b) by 34 days.

(21) Appl. No.: 14/141,855

(22) Filed: Dec. 27, 2013

(65) Prior Publication Data

US 2014/0113471 A1 Apr. 24, 2014

Related U.S. Application Data

(63) Continuation-in-part of application No. PCT/JP2012/066651, filed on Jun. 29, 2012.

(30) Foreign Application Priority Data

Jul. 1, 2011 (JP) ..... 2011-147106

(51) Int. Cl.

| | |
|---|---|
| ***H01R 13/629*** | (2006.01) |
| ***H01R 13/64*** | (2006.01) |
| ***H01R 13/514*** | (2006.01) |
| ***H01R 13/74*** | (2006.01) |

(52) U.S. Cl.

CPC ..... *H01R 13/64* (2013.01); *H01R 13/62938* (2013.01); *H01R 13/743* (2013.01); *H01R 13/514* (2013.01)

(58) Field of Classification Search

CPC ..... H01R 13/62938; H01R 13/62933; H01R 13/639; H01R 13/62955; H01R 13/64; H01R 13/6272; H01R 13/6395; H01R 43/26

USPC ..... 439/157, 372, 350, 299

See application file for complete search history.

(56) References Cited

U.S. PATENT DOCUMENTS

| | | | | |
|---|---|---|---|---|
| 5,279,506 | A * | 1/1994 | Kawase et al. | 439/157 |
| 5,308,255 | A * | 5/1994 | Yamanashi | 439/157 |
| 6,183,277 | B1 * | 2/2001 | Okabe et al. | 439/157 |
| 2002/0178538 | A1 | 12/2002 | Matsushita | |

FOREIGN PATENT DOCUMENTS

| | | | |
|---|---|---|---|
| JP | 09-245886 | A | 9/1997 |
| JP | 2002-359029 | A | 12/2002 |

OTHER PUBLICATIONS

International Search Report dated Sep. 11, 2012, issued for PCT/JP2012/066651.

* cited by examiner

*Primary Examiner* — James Harvey
*Assistant Examiner* — Oscar C Jimenez
(74) *Attorney, Agent, or Firm* — Locke Lord LLP

(57) ABSTRACT

A lever-operative connector which can be downsized includes a frame and a lever rotatably coupled to the frame. The frame has a circumferential wall having one opening and the other opening at both ends. The frame has a notch formed in the circumferential wall and communicating with the one opening. When the lever is rotated toward the one opening side, a part of a lever side wall is exposed from an interior of the circumferential wall so as to compensate the notch of the circumferential wall, thereby forming, together with the frame, a hood having the housing-receiving width. When the lever is rotated toward the other opening side, the part of the lever side wall is received inside the circumferential wall so as to open the notch of the circumferential wall, thereby eliminating the housing-receiving width and the hood.

7 Claims, 6 Drawing Sheets

LEVER-OPERATIVE CONNECTOR

TECHNICAL FIELD

The invention relates to a connector having a pair of connector housings, in particular, a lever-operative connector in which the pair of connector housings is fitted to each other by the operation of a lever so as to be received in a frame.

A conventional lever-operative connector to be attached to a panel is disclosed in JP H9-245886 A. In this conventional connector, a male connector housing is mounted to an engagement hole formed in a panel in advance, which may be referred to as a "standby state", and a female connector housing having a lever is fitted into the male connector housing in the standby state. Then, the two connector housings are brought into a normal engagement state (i.e., fitting engagement state) by the operation of the lever.

The above connector in which the lever is operated outside the panel, in its engagement state, has a part of the female connector housing and the lever externally extending from the panel. For the reason, a surplus space should be accordingly needed. However, when the connector is mounted to, for example, a location adjacent to the hinge of the door panel, such surplus space is difficult to secure between the hinge of the door panel in a closed state and a body panel. As a result, the afore-mentioned lever-operative connector is not practical.

In order to overcome the above problem, JP 2002-359029 A has provided that a male connector housing and a female connector housing are fitted into each other outside the door panel in advance, then the two connector housings engages an engagement hole formed in a panel, and then the two connector housings and a lever are received inside the door panel.

More specifically, a locking portion for the engagement hole is formed in the posterior end portion of the male connector housing which has a hood portion in its anterior end portion. Then, the lever rotatably supported by the male connector housing is located in its standby state. Accordingly, an inlet of the cam groove formed in the lever is opened to a front surface side. Then, in this state, the female connector housing is slightly fitted into the hood. As such, a cam follower formed in the female connector housing is inserted into the cam groove of the lever. Subsequently, the cam follower is guided along the cam groove by the rotation of the lever toward its engagement position. As such, the male connector housing engages the female connector housing. Finally, the lever-operative connector in which the male connector housing engages the female connector housing is attached to the engagement hole formed in the panel. In this situation, the locking portion disposed in the posterior end of the male connector housing is locked to the edge of the engagement hole. As a result, the lever-operative connector is received inside the panel.

CITATION LIST

Patent Literature

[PTL 1]
JP H9-245886 A
[PTL 2]
JP 2002-359029 A

SUMMARY OF INVENTION

Technical Problem

In accordance with the configuration as disclosed in JP 2002-359029 A, the width for receiving the female connector housing is defined by the hood of the male connector housing and the lever disposed outside the hood. In other words, the width corresponds to a double structure. For the reason, downsizing is substantially limited. Furthermore, it is difficult to attach the connector to the narrow space, for example, a location adjacent to the hinge of the door panel.

In order to overcome the above problems, a lever-operative connector which can be downsized is provided.

Solution to Problem

In one aspect of the invention, there is provided a lever-operative connector, which includes a tube-shaped frame having a circumferential wall having one opening and the other opening at both ends, a lever rotatably coupled to the frame, one connector housing having a follower, which is engageable with a cam portion of the lever, and being capable of being received inside the frame via a housing-receiving width communicating with the one opening, and the other connector housing received inside the frame via the other opening, and being engageable with the one connector housing. The lever is rotated from the one opening side toward the other opening side so as to guide the follower along the cam portion, thereby causing the one connector housing to be received inside the frame. The frame has a notch formed in the circumferential wall and communicating with the one opening. When the lever is rotated toward the one opening side, a part of a lever side wall is exposed from an interior of the circumferential wall so as to compensate the notch of the circumferential wall, thereby forming, together with the frame, a hood having the housing-receiving width. When the lever is rotated toward the other opening side, the part of the lever side wall is received inside the circumferential wall so as to open the notch of the circumferential wall, thereby eliminating the housing-receiving width and the hood.

In accordance with the above embodiment, the lever-operative connector is provided with a frame, a lever, one connector housing, and the other connector housing. The frame has a shape of tube, with one opening and the other openings at its both ends. The frame has a notch formed in the circumferential wall and communicating with the one opening.

The lever is rotatably coupled or mounted to the frame. When the lever is rotated toward the one opening side, a part of a lever side wall is exposed from an interior of the circumferential wall so as to compensate the notch of the circumferential wall. As a result, the lever together with the frame can form a hood having a housing-receiving width. When the lever is rotated toward the other opening side, the part of the lever side wall is received inside the circumferential wall so as to open the notch of the circumferential wall. As a result, the lever can eliminate the housing-receiving width and the hood.

The one connector housing has a follower, which is engageable with a cam portion of the lever, and is capable of being received inside the frame via a housing-receiving width. The other connector housing is received inside the frame via the other opening, and is engageable with the one connector housing. The lever is rotated from the one opening side toward the other opening side so as to guide the follower along the cam portion, thereby allowing the one connector housing to be received inside the frame.

In accordance with the embodiment of the lever-operative connector, only when the one connector housing is received in the frame, the notch is compensated by the rotation of the lever, thereby forming, together with the frame, the hood having the housing-receiving width. After the one housing connector is received in the frame 2, the notch is opened by the rotation of the lever in an opposite direction. As a result, the hood and the housing-receiving width are eliminated or lost. In accordance with the above configuration, downsizing and space-saving can be attained by not adopting a double configuration of the hood and the lever. In other word, it is possible to provide a downsized, space-saving lever-operative connector.

In second aspect of the invention, an interior of the circumferential wall may be provided with a rib extending in a direction connecting the one opening to the other opening and not interfering with the rotation of the lever, and the one connector housing may be provided with a guide groove which is engageable with the rib.

In accordance with the above embodiment of the lever-operative connector; the one connector housing is provided with a guide groove, which is engageable with the rib formed inside of the circumferential wall of the frame. In this configuration, the one connector housing is received in the frame in an appropriate manner in which the movement and inclination thereof is regulated. For the reason, once the one connector housing starts to be received in the frame, it would be received in the frame in an appropriate manner, thereby not needing the hood, as well as, the housing-receiving width. In other words, the hood and the housing-receiving width may be lost or eliminated. Accordingly, the above embodiment of the lever-operative connector in its receiving state is configured to receive a part of each lever side wall inside the circumferential wall of the frame, thereby turning to its compacted state.

In the third aspect of the invention, the one opening side of the circumferential wall may be firstly passed through the panel so that the circumferential wall of the frame is coupled to the panel.

In accordance with the above embodiment of the invention, the circumferential wall adjacent to the one opening is firstly passed into the panel so that the frame is coupled to the panel. The circumferential wall of the frame has the notch formed therein, thereby obtaining a downsized, space-saving connector. For the reason, the lever-operative connector can be easily mounted to, for example, a narrow space adjacent to the hinge of the vehicle door panel.

Advantageous Effects of Invention

In the first aspect of the invention, a double configuration of the hood and the lever is not needed any further, thereby attaining the downsized, space-saving lever-operative connector.

In accordance with the second aspect of the invention, after the one connector is received in the frame, a part of the lever side wall is received inside the circumferential wall of the frame. As such, the connector can turn its compacted state. Accordingly, the downsized, space-saving lever-operative connector can be provided.

In accordance with the third aspect of the invention, there is provided the downsized, space-saving lever-operative connector which can be easily mounted to, for example, a narrow space adjacent to the hinge of the vehicle door panel.

DESCRIPTION OF EMBODIMENTS

One embodiment of a lever-engagement connector 1 in accordance with the invention will be hereinafter described with reference to FIGS. 1-8. Firstly, the configuration of the one embodiment of the lever-operative connector 1 will be explained in detail.

[Configuration of Level-Engagement Connector]

Figure 1:
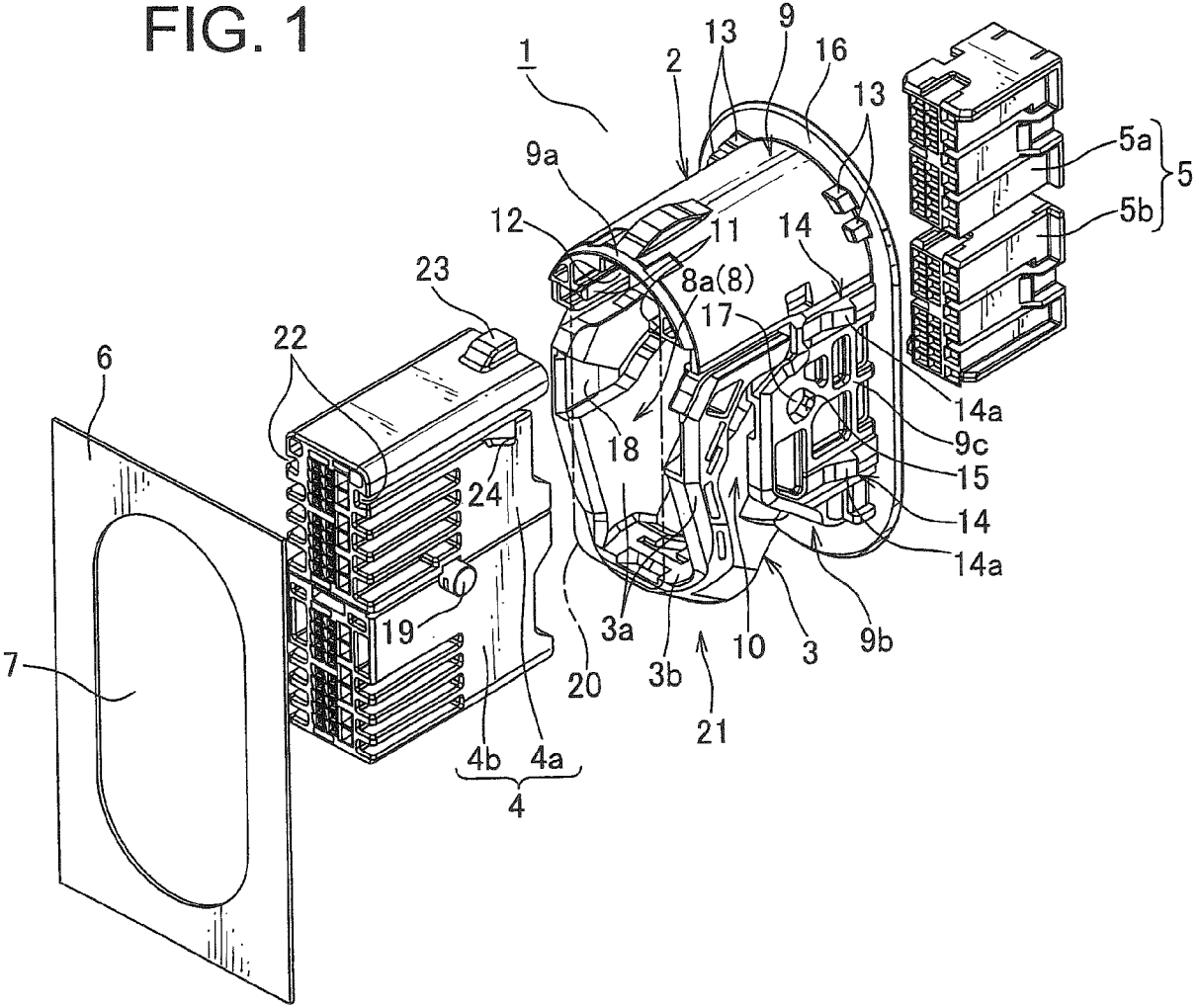
FIG. 1 is an exploded perspective view of one embodiment of a lever-operative connector in accordance with the invention.

Referring to FIG. 1, one embodiment of the lever-operative connector 1 includes a frame 2, a lever 3, one connector housing 4, and the other connector housing 5. The connector 1 is attached to a panel 6 by passing the frame 2 through an engagement hole 7 formed in, for example, the panel 6 such as a door panel of a vehicle. Furthermore, FIG. 1 is an exploded perspective view of the lever-operative connector 1.

Figure 3:
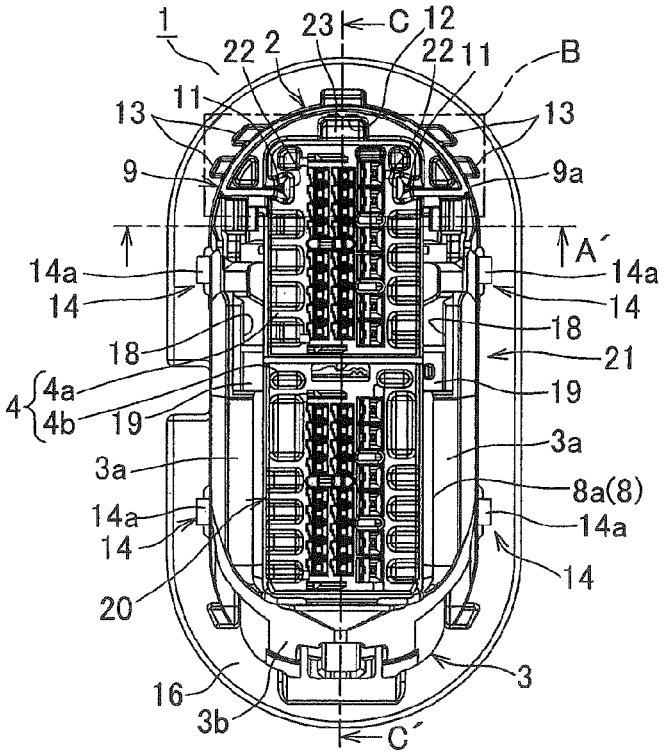
FIG. 3 is a front view of the lever-operative connector of FIG. 2, as viewed from one opening thereof.
Figure 4:
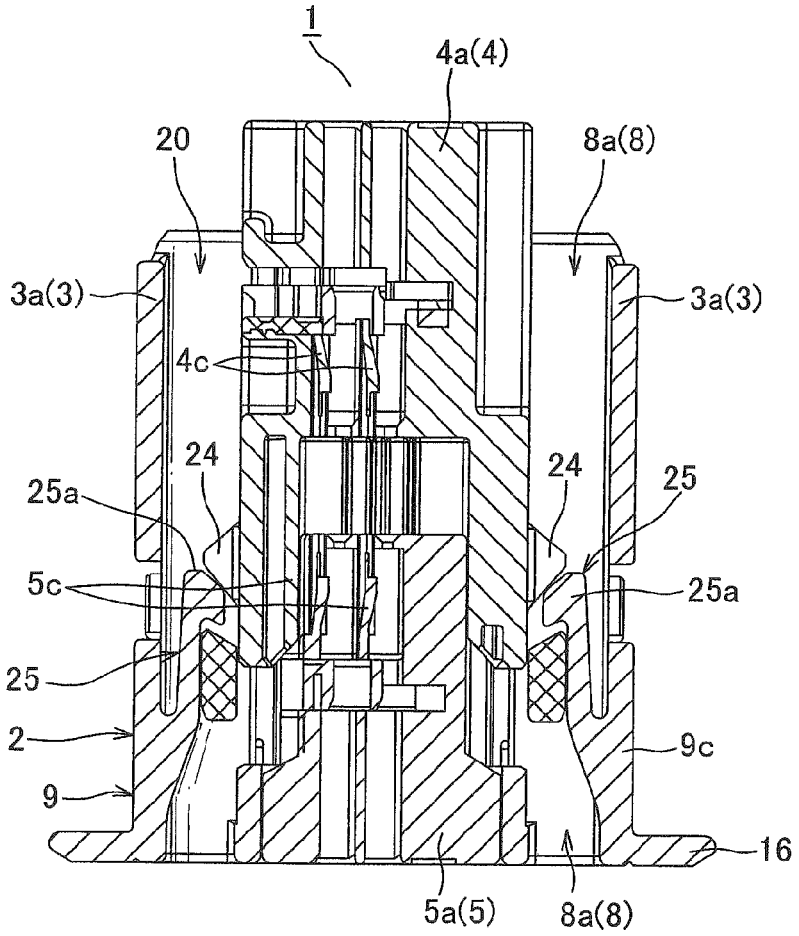
FIG. 4 is a cross-sectional view of FIG. 3 along the line A-A'.

Referring to FIG. 4, the frame 2 is approximately tube-shaped with both opened ends. Specifically, the frame 2 has, as a body, a hollow circumferential wall 9 with an opening 8 at its each of both ends. Referring to FIGS. 1-3, 5 and 6, one of the opening 8*a* is depicted, and the other opening 8*b* is not shown. Furthermore, with reference to FIGS. 1-9, for explanation, the one opening 8*a* side may be referred to as "anterior side", and the other opening 8*b* side may be referred to as "posterior side".

The size and appearance (i.e., shape) of the circumferential wall 9 is formed in conformity with the size and shape of the engagement hole 7 formed in the panel 6. In one embodiment, the engagement hole 7 is ellipse or oval-shaped. As such, the circumferential wall 9 has a shape similar to that of the engagement hole 7, and has a size slightly smaller than that of the engagement hole 7. In other word, the circumferential wall 9 is ellipse or oval-shaped in its front view. The connector 1 is assembled by passing the circumferential wall 9 of the frame 2 through the panel 6. In detail, the one opening 8*a* side of the circumferential wall 9 is firstly passed through the panel 6. A direction in which both of the openings 8*a* and 8*b* are connected to each other may be referred to as a "height direction of the circumferential wall 9". Furthermore, the height direction of the circumferential wall 9 corresponds to an axial direction of the frame 2 having a tube shape.

Figure 6:
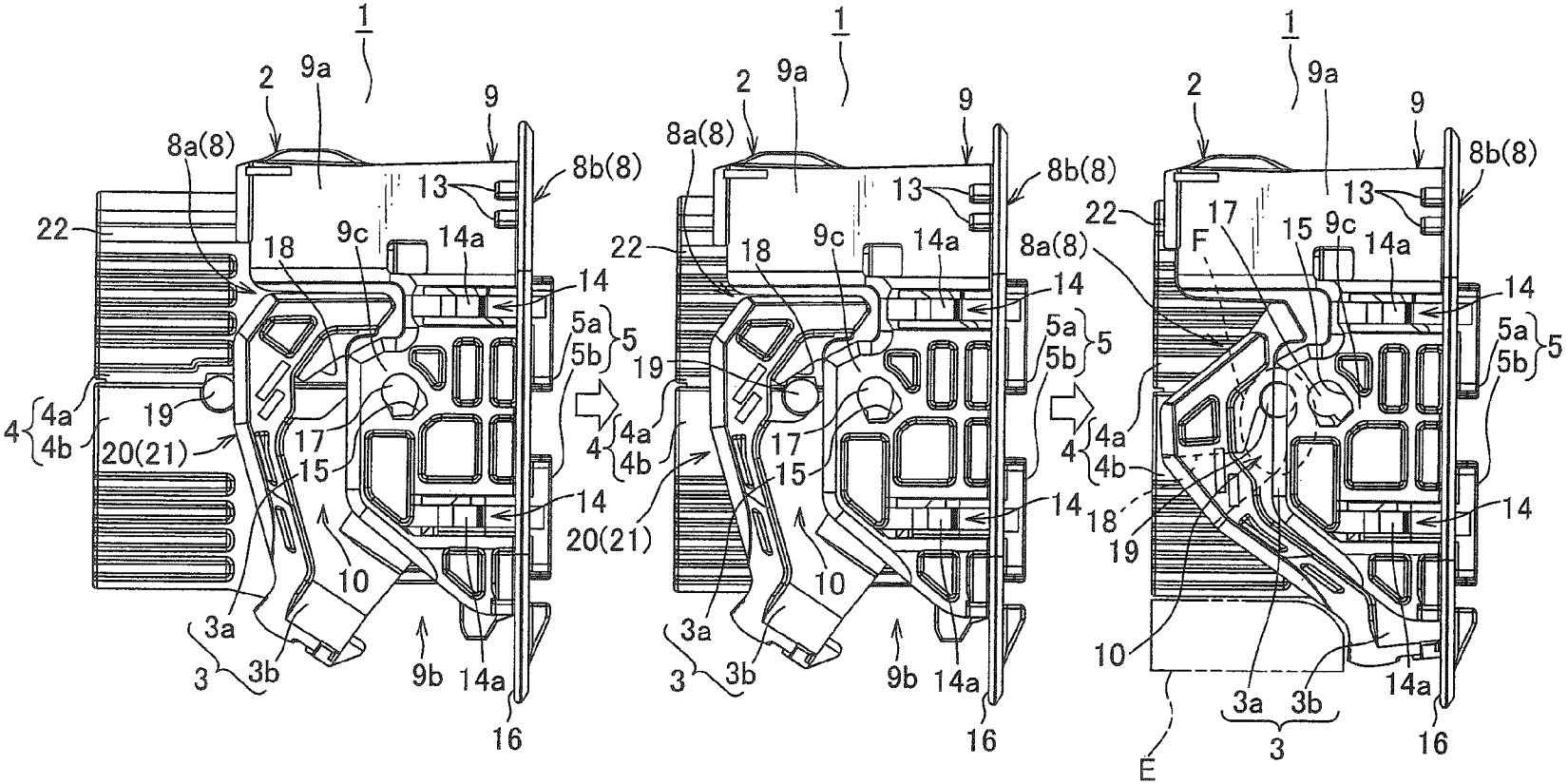
FIG. 6 is a side view illustrating a process for assembling one embodiment of the lever-operative connector in accordance with the invention.
Figure 7:
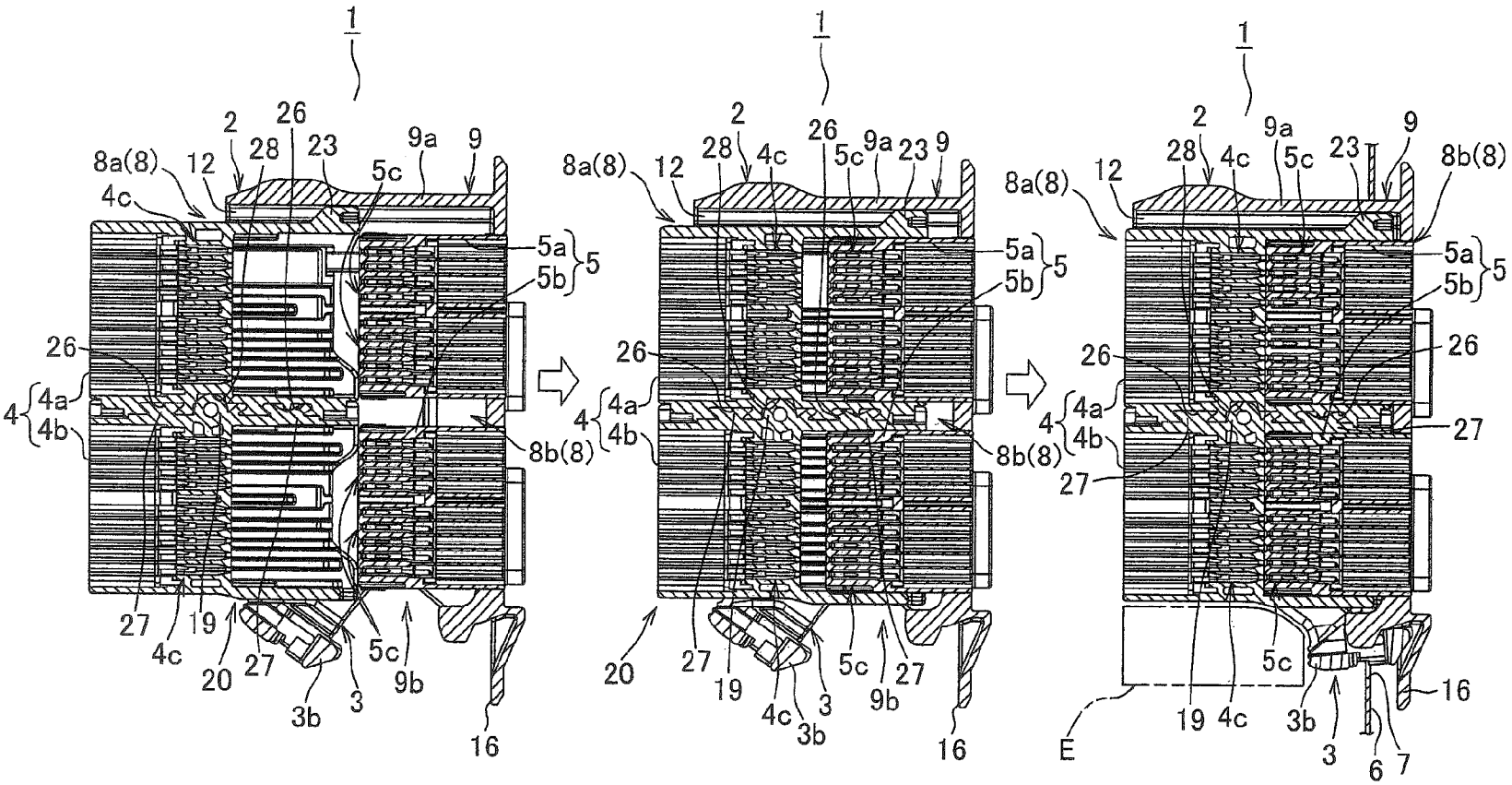
FIG. 7 is a cross-sectional view of each step shown in FIG. 6 along two dot chain line C-C' of FIG. 3.

A notch 10, which is a cut out portion, is disposed a part of the circumferential wall 9, and communicates with the one opening 8*a*. In detail, the circumferential wall 9 has a semi-circular end 9*a* along its longitudinal direction in its front view. Accordingly, the one end 9*a* of the circumferential wall 9 may be referred to as a "curved portion". Inside both sides of the curved portion 9*a*, there is provided a pair of ribs 11 extending in the height direction of the circumferential wall 9 connecting the one opening 8*a* to the other opening 8*b*. Inside the center or middle portion along the circumferential direction of the curved portion 9*a* which is an apex of the circumferential wall 9, there is a frame-side guide groove 12 extending along the height direction of the circumferential wall 9. Referring to FIGS. 6 and 7, the ribs 11 and the guide groove 12 are configured to guide the one connector housing 4 into the frame 2 and receive the one connector housing 4 in the frame 2 in an appropriate position. Furthermore, the each rib 11 and the guide groove 12 are formed in a position and with a shape not interfering with the rotation of the lever 3 such that the rotation of the lever 3 is not disturbed.

On the outer periphery of the end of the curved portion 9*a* adjacent the other opening 8*b*, there are four panel stoppers (i.e., protrusions) 13 for preventing excessive entry of the frame 2 into the panel 6. As the circumferential wall 9, from the one opening 8*a* side, is inserted into the engagement hole 7 of the panel 6, each protrusion 13 abuts against an end face of the panel 6 which corresponds to an edge of the engagement hole 7. As such, when the frame 2 is attached or coupled to the panel 6, the entry of the frame 2, in particular, the circumferential wall 9 into the panel 6 is stopped at an appropriate position.

In comparison to the curved portion 9*a* of the circumferential wall 9 as mentioned previously, the other end of the circumferential wall 9 is almost removed, and thus substantially opened. For the reason, the opened end of the circumferential wall 9 may be referred to as an "opened end portion 9*b*". Through FIGS. 1-9, for explanation, the curved portion 9*a* side may be referred to as "upper" side, and the opened end portion 9*b* side may be referred to as "lower" side. In a similar manner, in a position that the curved portion 9*a* of the circumferential wall 9 is disposed at upper side, and the opened end portion 9*b* of the circumferential wall 9 is disposed at lower side, the right side corresponds to the left side of the frame 2 and the left side corresponds to the right side of the frame 2 in the front view of the frame 2 as viewed from the one opening 8*a* (i.e., the anterior side).

The circumferential wall 9 is provided with a pair of left and right side walls 9*c* opposed to each other and parallel to each other which is smoothly continuous with each of the both sides of the remained curved portion 9*a*. Each of the side walls 9*c* has a shape of an approximate plate extending along the longitudinal direction of the circumferential wall 9. An approximate half portion facing the one opening 8*a* is removed from each of the side wall 9*c*. In addition, a corner facing both the one opening 8*a* and the opened end portion 9*b* are obliquely removed from the each side wall 9*c*. Specifically, each side wall 9*c* has an approximately trapezoidal shape such that the length along the longitudinal axis of the circumferential wall 9 is gradually greater as it approaches the other opening 8*b* away from the one opening 8*a*. As such, in accordance with the embodiment of the invention, the curved portion 9*a* at upper side together with the pair of side walls (i.e., the left and right side walls) 9*c* forms an approximately inverted U-shape in the front view of the circumferential wall 9 having an approximate ellipse shape.

Each of the side walls 9*b* is provided with two flexible, frame-locking portions 14 which are configured to prevent the frame 2 from falling or slip out of the panel 6. One of the flexible, frame-locking portion 14 is disposed in the vicinity of the connection between the both sides of the curved portion 9*a* and the each side wall 9*c*. The other flexible, frame-locking portion 14 is disposed adjacent to the corner which is obliquely removed from each side wall 9*c*. Each of the frame-locking portions 14 extends in the height direction of the circumferential wall 9. As the circumferential wall 9, firstly the one opening 8*a* side, is inserted into the engagement hole 7, the abutting portion 14*a* of each the left and right frame-locking portions engages the end face of the panel 6 which defines the edge of the engagement hole 7. As such, during the attachment of the frame 2 to the panel 6, the circumferential wall 9 (i.e., the frame 2) is prevented from slipping or falling off from the panel 6. In addition, the panel 6 is clamped at both front and back sides by the frame-locking portions 14 and the panel stoppers (protrusions) 13, thereby allowing the frame 2 (i.e., a connector 1) to be locked and coupled to the panel 6 at its appropriate position.

The corner of each side wall 9*c* facing both the one opening 8*a* and the one end portion 9*a* is provided with a bearing hole 15 for the attachment of the lever 3. The end portion of the circumferential wall 9 adjacent to the other opening 8*b* is provided a flange 16 externally extending from the outer periphery of the other opening 8*b*. For differentiating the side wall 9*c* of the circumferential wall 9 from a side wall 3*a* of the lever 3 which will be described below, the side wall 9*c* of the circumferential wall 9 may be referred to as a "frame side wall".

The lever 3 is rotatably mounted in the frame 2. The lever 3 has a size and shape which can partly compensate the opened end portion 9*b* of the circumferential wall 9 and the notch 10. As mentioned previously, the curved portion 9*a* at upper side together with the pair of side walls (i.e., the left and right side walls) 9*c* forms an approximately inverted U-shape. Accordingly, as shown in FIG. 3, the lever 3 is approximately U-shaped in its front view. The lever 3 is coupled to the frame 2 such that the front view of the lever 3 is approximately U-shaped.

Specifically, the lever 3 includes a pair of side walls (i.e., a left and right side walls) 3*a*, and a connecting portion 3*b* communicating with the side walls 3*a*. The side walls 3*a* of the lever 3 are opposed to each other, and are parallel to each other. The side walls 3*a* of the lever 3 are approximately plate-shaped as the frame side walls 9*c*. Over each of left and right outer sides of each side wall 3*a* of the lever 3, there is provided a supportive shaft 17 opposed to each bearing hole 15 formed in each of the frame side walls 9*c*. The lever 3 is rotatably attached to the interior of each frame side wall 9*c* by the engagement of each supportive shaft 17 with each bearing hole 15. The left and right outer side faces of each side wall 3*a* of the lever 3 and the left and right outer side faces of each frame side wall 9*c* are substantially coplanar. For the reason, the embodiment of the lever-operative connector 1 is not a configuration in which the frame is exteriorly covered by the lever, or lever outwardly extends from the frame. In order to differentiate the side wall 3*e* of the lever 3 from the frame side wall 9*c*, the side wall 3*c* of the lever 3 may be referred to as a "lever side wall".

Over the left and right inner sides of each lever side wall 3*a*, there is provided a cam portion 18 which is engageable with a cam follower 19 disposed in the one connector housing 4. The cam follower 19 may be a boss projecting from the left and right outer sides of the connector housing 4. Furthermore, each cam portion 18 may be a cam groove, which is configured to guide each boss 19 while receiving each boss 19 therein. In order to facilitate the entrance of the boss 19 therein, the cam groove 18 has an opening wider than the other portions. The cam groove 18 is configured that the boss 19, once being entered, is difficult to fall off or deviate therefrom during the rotation of the lever 3. The cam groove 18 is configured that the one connector housing 4 can be moved into and/or out of the frame 2 in response to the rotation of the lever 3.

In particular, the cam groove 18 is configured that the mating boss 19 is smoothly guided along the cam groove 18 toward the inside (interior) of the frame 2 by rotating the lever 3 from the one opening 8*a* side of the circumferential wall 9 toward the other opening 8*b* side. The cam groove 18 is configured that the mating boss 19 is smoothly guided along the cam groove 18 toward the outside (exterior) of the frame 2 by rotating the lever 3 from the other opening 8*b* side of the circumferential wall 9 toward the one opening 8*a* side. As such, the rotation of the lever 3 allows the one connector housing 4 to be smoothly guided and received into the frame 2.

Regardless of the state (i.e., rotation state) of the lever 3, a major portion of frame 2 side edge of the lever side wall 3*a* overlaps with the frame side wall 9*c* inside the lever side wall 3*a*. In comparison, an edge of the lever side wall 3*a* opposite to the frame 2 side edge outwardly extends from the frame side wall 9*c*, regardless of the state (i.e., rotation state) of the lever 3. Furthermore, a middle portion between the anterior edge and the posterior edge of the lever side wall 3*a* may extend from the frame side wall 9*c* or be received inside the frame side wall 9*c* in response to the rotation of the lever 3.

Figure 2:
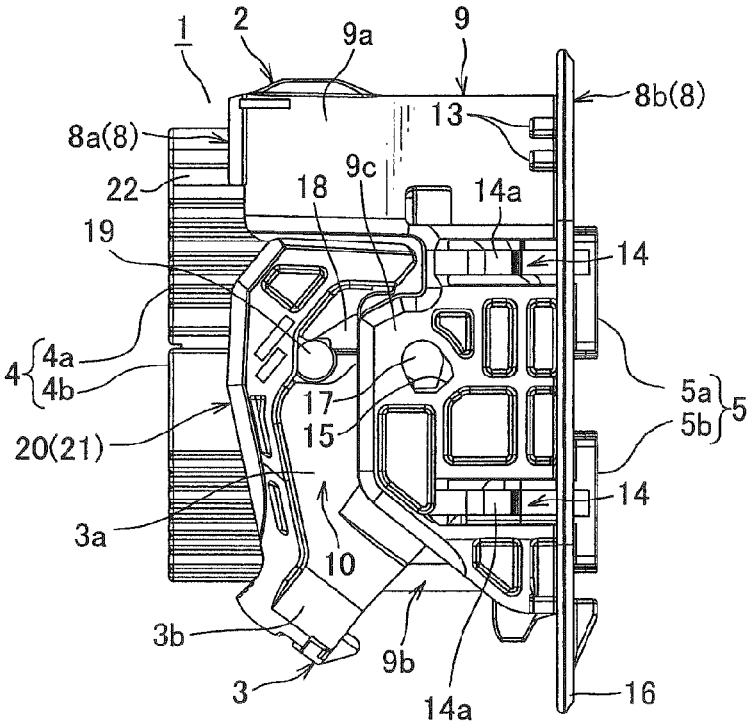
FIG. 2 is a side view of one embodiment of a lever-operative connector in accordance with the invention.
Figure 8:
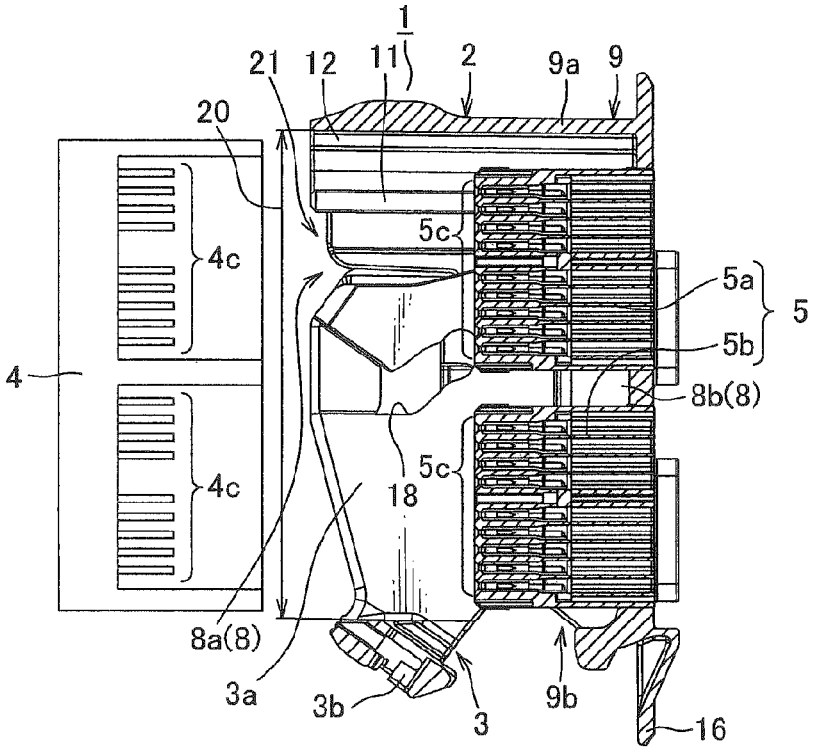
FIG. 8 is a cross-sectional view illustrating the relationship between one connector housing and the other connector housing in one embodiment of the lever-engagement connector in accordance with the invention.

Referring to FIG. 2, the left figure and middle figure of FIG. 6, and FIG. 8, the lever 3 is rotated toward the one opening 8*a* of the circumferential wall 9 until the upper edge of the lever 3 abuts against the lower edge of the curved portion 9*a* of the circumferential wall 9, thereby regulating the rotation of the lever 3. This state can be referred to as "standby state". In this standby state, the maximum amount of the lever side wall 3*a* exposed from or extending from the frame side wall 9*c* can be obtained. In this state, the side wall 3*a* of the lever 3 has such size and shape as the notch 10 of the circumferential wall 9 can be overall covered. Also, in this state the lever side wall 3*a* has such size and shape as the opening 8*a* side edge thereof and the edge of the curved portion 9*a* adjacent to the one opening 8*a* are approximately coplanar. The lever side wall 3*a* is configured that the connecting portion 3*b* is located lower than the lower edge or end of the frame side wall 9*c*. FIG. 2 illustrates the side view of the embodiment of the lever-operative connector 1 in accordance with the invention.

In accordance with the above configuration, the frame 2 has the one opening 9*a* having a size equal to or greater than the other opening 8*b*, and can thus smoothly receive the one connector housing 4 therein. In other word, when the one connector 4 is received inside the frame 2, the lever 3 outwardly extends or be pulled out toward the one opening 8*a*, thereby forming the hood portion 21 having a housing-receiving opening 20, together with the frame 2. In this state, the housing-receiving opening 20 substantially corresponds to the one opening 8*a* of the circumferential wall 9 and the frame 2.

Referring to the right figure of FIG. 6, the lever 3 is rotated toward the other opening 8*b* of the circumferential wall 9 until the connecting portion 3*b* of the lever 3 abuts against the front face of the flange 16 of the circumferential wall 9, thereby regulating the rotation of the lever 3. This state can be referred to as "receiving state". In this receiving state, the minimum amount of the lever side wall 3*a* exposed from or extending from the frame side wall 9*c* can be obtained. In this state, the side wall 3*a* of the lever 3 has such size and shape as the notch 10 of the circumferential wall 9 is partly covered along the contour of the frame side wall 9*c*. Also, in this state the lever side wall 3*a* has such size and shape as a part of the opening 8*a* side edge thereof and the edge of the curved portion 9*a* adjacent to the one opening 8*a* are approximately coplanar. For the reason, almost the notch 10 of the circumferential wall 9 is open to the lever side wall 3*a*. Furthermore, the lever side wall 3*a* is configured that the connecting portion 3*b* is located lower than the lower edge or end of the frame side wall 9*c*.

The corner of the lever side wall 3*a* adjacent to the connecting portion 3*b* is obliquely removed in the same manner as the corner of the frame side wall 9*c* facing the one opening 8*a* and the opened end portion 9*b* is obliquely removed. In particular, the corner of the lever side wall 3*a* adjacent the connecting portion 3*b*, opposed to the frame side wall 9*c* and facing the other opening 8*b* of the circumferential wall 9 and the opened end portion 9*b* is obliquely cut away. In other words, in comparison to the frame side wall 9*c*, each lever side wall 3*a* has an approximately trapezoidal shape such that the length along the longitudinal axis of the circumferential wall 9 is gradually less as it approaches the other opening 8*b* away from the one opening 8*a*. The lever side wall 3*a* in a state where the lever 3 is located most adjacent to the other opening 8*b* is configured that the edge of the obliquely-removed corner and its edge adjacent the other opening 8*b* are approximately coplanar. The lever 3 is attached to the frame 2 such that the obliquely-removed corner of the lever side wall 3*a* is opposed to the obliquely-removed corner of each lever side wall 3*a* is opposed to the obliquely-removed corner of each side wall 9*c* of the circumferential wall 9.

In accordance with the this configuration, the lever 3 in the receiving state can upwardly cover the opened end portion 9*b* of the circumferential wall 9 while ensuring the size of the opening 8*a* equal to or greater than the other opening 8*b*. For the reason, the lever 3 can effectively protect the one and the other connector housings 4 and 5 received inside the frame 2, without interfering the connector housings 4, 5. In the receiving state in which the one connector housing 4 is already received in the frame 2, almost the lever side wall 3*a* is received in each of the frame side wall 9*c*, and is not substantially exposed. As a result, the configuration of the hood 21 defined by the frame 2 and the lever 3 is released and thus lost. Further, the housing-receiving opening 20 which corresponds to the opening of the hood 21 is accordingly lost.

In the embodiment of the invention, the one connector housing 4 can be referred to as a male connector housing. The male connector housing 4 is defined by two connector housings (i.e., upper and lower connector housings 4*a* and 4*b*).

Figure 5:
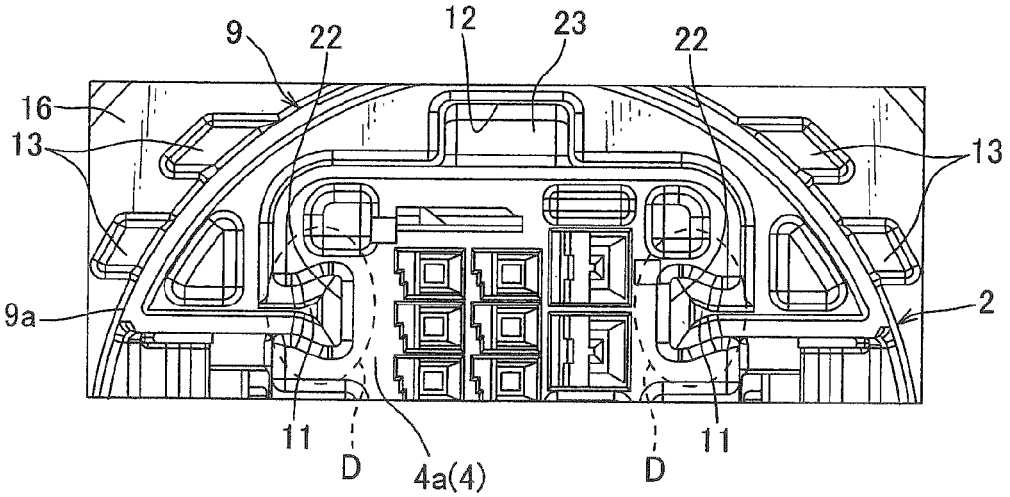
FIG. 5 is an enlarged view of the area B encircled by two dot chain line in FIG. 3.

Referring to FIG. 3, over the left and right outer faces of the upper connector housing 4*a* there is provided a pair of rib grooves 22, which is respectively engageable with the ribs 11 inwardly projecting from the curved portion 9*a* of the frame 2. Each rib groove 22 extends in an anterior-and-posterior direction of the upper connector housing 4*a* in conformity with the height direction of the circumferential wall 9 connecting the one opening 8*a* of the frame 2 and the other opening 8*b* of the frame 2. The above direction corresponds to a direction in which the male connector housing 4 is received inside the frame 2. FIG. 3 is a front view of the lever-operative connector 1 of FIG. 2, as viewed from the one opening 8*a*. In order to facilitate the understanding of the configuration of the rib 11 and the rib groove 22, FIG. 5 provides an enlarged view of the area B encircled by two dot chain line in FIG. 3.

Referring to FIG. 7, an upper guide 23, which is engageable with a guide groove 12 disposed in the interior of the curved portion 9*a* of the frame 2, is disposed in the posterior portion of the upper face of the upper connector housing 4*a*. The male connector housing 4 is guided into and received in the frame 2 in an appropriate position by the engagement of the rib groove 22 and the upper guide 23 of the male connector housing 4 with the rib 11 and guide groove 12 of the curved portion 9*a* of the frame 2.

On the left and right outer surfaces of the upper connector housing 4*a* and directly below the rib groove 22, there is provided a pair of protrusions (i.e., housing stoppers) 24. Referring to FIG. 4, each of the protrusions 24 is configured that it is engageable with a flexible abutting portion 25*a* of each housing locking portion 25 disposed inside the frame side wall 9*c*. For the reason, as the male connector housing 4 is entered toward the interior of the frame 2 from the one opening 8*a*, each protrusion (housing stopper) 24 engages the abutting portion 24*a* of the housing locking portion 25. As such, the entrance of the male connector housing 4 can be stopped at an appropriate position. FIG. 4 is a cross-sectional view of FIG. 3 along the line A-A'.

Referring to FIG. 7, there are provided two housing-assembling grooves 26 in the lower portion of the upper connector housing 4*a*. In response to such configuration of the upper connector housing 4*a*, there are provided two housing-assembling ribs 27 in the upper portion of the lower connector housing 4*b*. The upper connector housing 4*a* and the lower connector housing 4*b* are assembled by engagement of each housing-assembling groove 26 with each housing-assembling rib 27. At the center portion of the upper portion of the lower connector housing 4*b*, the projecting boss 19 is provided in each housing-assembling rib 27. At the center portion of the lower portion of the upper connector housing 4*a*, there is provided a boss-receiving depression 28 as a follower-receiving portion, into which the boss 19 is inserted, in each housing-assembling groove 26. In other words, the boss-receiving depression 28 is disposed in the housing-assembling groove 26 at a position corresponding to the position of the boss 19 disposed in the housing-assembling rib 27. Due to the above configuration, the upper connector housing 4*a* and the lower connector housing 4*b* can be integrally assembled in an appropriate state without vibration or shaking.

In the embodiment of the invention, the other connector housing 5 may be referred to as a female connector housing. The female connector housing 5 is defined by two connector housings 5*a* and 5*b* (i.e., upper connector housing and lower connector housing). However, in comparison to the male connector housing 4, the upper connector housing 5*a* and the lower connector housing 5*b* are not integrated and are separately treated. In comparison to the male connector housing 4, the upper and lower the connector housings 5*a*, 5*b* are received in the frame 2 via the other opening 8*b*.

The female connector housings 5*a*, 5*b* are received in the frame 2 prior to the male connector housings 4*a*, 4*b*. When the male connector housings 4*a*, 4*b* are properly received in the frame 2, the male connector housings 4*a*, 4*b* engage the female connector housings 5*a*, 5*b*. A plurality of male terminals 4*c* provided in the male connector housings 4*a*, 4*b* is coupled to a plurality of female terminal 5*c* provided in the female connector housings 5*a*, 5*b*. A conductor wire (not shown) electrically connected to each male terminal 4*c* and each female terminal 5*c* is pulled or led out of each of the male connector housings 4*a*, 4*b* and each of the female connector housings 5*a*, 5*b*.

Next referring to FIGS. 6 and 7, a process for assembling the embodiment of the lever-operative connector 1 is explained. FIG. 6 is a side view illustrating a process for assembling one embodiment of the lever-operative connector 1 in accordance with the invention. FIG. 7 is a cross-sectional view of each step shown in FIG. 6 along two dot chain line C-C' of FIG. 3.

[Process for Assembling the Lever-Operative Connector]

Referring to FIGS. 6 and 7, the lever 3 is rotatably coupled to the frame 2 in advance. The upper and lower female connector housings 5*a*, 5*b* are received in the frame 2 in advance. Subsequently, the lever 3 is set to its standby state or its standby position by rotating the lever 3 such that the lever 3 is moved toward the one opening 8*a* of the circumferential wall 9 (i.e., the anterior of the frame 2) until it is stopped. As such, a maximum amount of the lever side wall 3*a* is exposed from the frame side wall 9*c*, thereby forming the hood 21, which is defined by the frame 2 and the lever 3, adjacent to the opening 8*a* of the frame 2. At the same time, as shown in FIG. 1, the housing-receiving opening 20 is formed in the end face of the hood 21. Independently of these operations, the upper male connector housing 4*a* and the lower male connector housing 4*b* are assembled in advance. Then, the male connector housing 4 in which the upper male connector housing 4*a* and the lower male connector housing 4*b* are assembled and integrated is inserted via the housing-receiving opening 20 of the hood 21 into the frame 2.

Next referring to FIG. 2, FIG. 6, and the center figure of FIG. 7, the pair of bosses 19 of the male connector housing 4 engages or is fitted into the cam groove 18 of the lever 3. Subsequently, the male connector housing 4 is further inserted or entered into the frame 2 and each boss 19 is thus inserted or entered into the cam groove 18 of the lever 3 until it reaches the position in which the housing-receiving operation can be performed by the lever 3.

Subsequently, as shown in FIG. 6 and the right figure of the FIG. 7, the lever 3 is set to its receiving position or its receiving state by rotating the lever 3 toward the other opening 8*b* (i.e., posterior of the frame 2) until it is stopped. In its receiving state or receiving position, a major portion of the lever side wall 3*a* is received in the frame side wall 9*c* and is not substantially exposed. In other word, in the case of the receiving state the configuration of the hood 21 defined by the frame 2 and the lever 3, as well as, the configuration of the housing-receiving width 20 corresponding to the opening of the hood 21 are lost.

In the receiving state, as shown in the right figure of FIG. 6 (in particular, the area "F" encircled by chain line) each boss 19 of the male connector housing 4 is guided into the deepest location of the lever 3 along the cam groove 18. As a result, the receiving operation of the male connector housing 4 in the frame 2 is completed. The male connector housing 4 properly engages the female connector housing 5 which has been already received in the frame 2. As a result, each male terminal 4*c* of the male connector housing 4 is properly coupled to each female terminal 5*c* of the female connector housing 5. In accordance with the embodiment of the lever-operative connector 1 in its receiving state, as shown in FIG. 6 and the right figure of FIG. 7 (in particular, the area "E" encircled by two dot chain line), a space is created under the male connector housing 4 received in the frame 2.

As such, the operation of assembling the embodiment of the lever-operative connector 1 is completed. Next, referring to the right figure of FIG. 7, the assembled connector 1, firstly the anterior of the circumferential wall 9, is inserted into the engagement hole 7 of the panel 6 until the protrusion (i.e., panel stopper) 13 formed in the curved portion 9*a* of the frame 2 abuts against the end face of the panel 6. The end face of the panel 6 engages the abutting portion 14*a* of the frame-locking portion 14 formed in the frame side wall 9*c*. As a result, the panel 6 is clamped at both front and back sides by the frame-locking portions 14 and the panel stoppers (protrusions) 13, thereby allowing the connector 1 to be appropriately attached or coupled to the panel 6. As such, the attachment of the embodiment of the lever-operative connector 1 to the panel 6 is completed.

As stated previously, in accordance with the embodiment of the lever-operative connector 1, the circumferential wall 9 of the frame 2 receiving the male connector housing 4 and the female connector housing is provided with the notch 10. Only when the male connector housing 4 is received in the frame 2, the notch 10 is compensated by the rotation of the lever 3, thereby forming together with the frame 2 the hood 21 having the housing-receiving width 20. After the male housing connector 4 is received in the frame 2, the notch 10 is opened by the rotation of the lever in an opposite direction, thereby eliminating the hood 21 and the housing-receiving width 20. In accordance with the above configuration, downsizing and space-saving can be attained by not adopting a double configuration of the hood 21 and the lever 3. In other word, it is possible to provide a downsized lever-operative connector 1.

In accordance with the embodiment of the lever-operative connector 1, the male connector housing 4 is provided with a rib groove 22, which is engageable with the rib 11 formed inside of the circumferential wall 9 of the frame 2. In this configuration, the male connector housing 4 is received in the frame 2 in an appropriate manner in which the movement and inclination thereof is regulated. For the reason, once the male connector housing 4 starts to be received in the frame 2, it would be received in the frame 2 in an appropriate manner, thereby not needing the hood 21, as well as, housing-receiving width 20. In other words, the hood 21 and the housing-receiving width 20 may be lost. Accordingly, the embodiment of the lever-operative connector 1 in its receiving state is configured to receive a part of each lever side wall 3*a* inside the circumferential wall 9 of the frame 2, thereby turning to its compacted state. Therefore, it is possible to provide a downsized lever-operative connector 1.

In accordance with the embodiment of the lever-operative connector 1, the circumferential wall 9 of the frame 2 is provided with the notch 10, and in its receiving state, the space is created under the male connector housing 4 received in the frame 2. For the reason, downsizing and space-saving of the connector can be realized. Therefore, the lever-operative connector 1 can be easily mounted to, for example, a narrow space adjacent to the hinge of the vehicle door panel 6.

The lever-operative connector in accordance with the invention is not limited by the afore-mentioned embodiment. The present invention has been described in terms of one or more preferred embodiments, and it should be appreciated that many equivalents, alternatives, variations, and modifications, aside from those expressly stated, are possible and within the scope of the invention.

Figure 9:
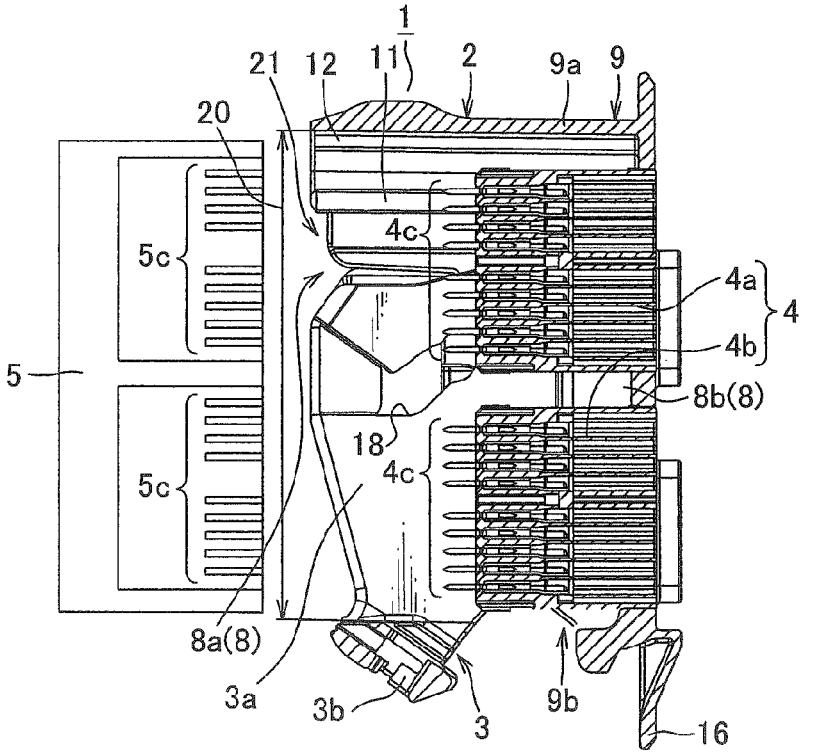
FIG. 9 is a cross-sectional view illustrating the relationship between one connector and the other connector housing in another embodiment of the lever-engagement connector in accordance with the invention.

For example, as shown in FIG. 8, in the above embodiment, the one connector housing 4 which is received from the one opening 8*a* side of the frame 2 into the frame 2 by the rotation of the lever 3 is the male connector housing. Furthermore, prior to the male connector housing 4 the female connector housing as the other connector housing 5 is received from the other opening 8*b* side of the frame 2 into the frame 2 in advance. However, as shown in FIG. 9, in comparison to the above embodiment, the one connector housing 4 can be a female connector housing, and the other connector housing 5 can be a male connector housing.

While the afore-mentioned embodiment employs a panel 6, it is not necessary for the lever-operative connector 1 to be attached to the panel 6. For example, the male connector housing 4 and the female connector housing 5 can be brought into an engagement without employing the panel 6.

INDUSTRIAL APPLICABILITY

In accordance with the invention, a lever is rotated so as to form a hood having a housing-receiving width for receiving one connector housing, together with a frame only when the one connector housing is received in the frame. After the one housing connector is received in the frame, a notch is opened by the rotation of the lever in an opposite direction, thereby eliminating the hood and the housing-receiving width. Therefore, a double configuration of the hood and the lever is removed or eliminated, thereby attaining downsizing and space-saving of the connector.

REFERENCE SIGN

1 lever-operative connector
2 frame
3 lever
3*a* lever side wall
3*b* connecting portion
4 male connector housing (one connector housing)
4*a* upper male connector housing (one connector housing)
4*b* lower male connector housing (one connector housing)
4*c* male terminal
5 female connector housing (the other connector housing)
5*a* upper female connector housing (the other connector housing)
5*b* lower female connector housing (the other connector housing)
5*b* female terminal
6 panel
7 engagement hole
8 opening of frame
8*a* one opening of the frame
8*b* the other opening of the frame
9 circumferential wall of the frame
9*a* curved portion of the circumferential wall
9*b* opened end portion of the circumferential wall
9*c* side wall of the circumferential wall (or frame side wall)
10 notch of the circumferential wall
11 rib
12 guide groove
13 panel stopper (protrusion)
14 frame-locking portion
14*a* abutting portion of the frame-locking portion
15 bearing hole
16 flange
17 supportive shaft
18 cam groove (cam portion)
19 boss (follower)
20 housing-receiving width
21 hood
22 rib groove
23 upper guide
24 housing stopper (protrusion)
25 housing-locking portion
25*a* abutting portion of the housing-locking portion
26 housing-assembling groove
27 housing-assembling rib
28 boss-receiving depression (cam follower-receiving portion)
D a location or area of an engagement of rib and rib groove
E a space created in the receiving state
F a location or area of an engagement of boss (cam follower) and cam groove (cam portion)

The invention claimed is:

1. A lever-operative connector, comprising:

a tube-shaped frame having a circumferential wall having one opening and a second opening at both ends;

a lever rotatably coupled to the frame;

one connector housing having a follower, which is engageable with a cam portion of the lever, and being capable of being received inside the frame via a housing-receiving width communicating with the one opening; and a second connector housing received inside the frame via the second opening, and being engageable with the one connector housing, wherein the lever is rotated from the one opening side toward the second opening side so as to guide the follower along the cam portion, thereby allowing the one connector housing to be received inside the frame, wherein the frame has a cut out portion formed in a part of the circumferential wall and communicating with the one opening, wherein when the lever is rotated toward the one opening side, each part of a lever side wall is exposed from the interior of the circumferential wall so as to entirely fill the cut out portion of the circumferential wall, thereby forming, together with the frame, a hood having the housing-receiving width, and wherein when the lever is rotated toward the second opening side, the part of each lever side wall is received inside the circumferential wall so as to open the cut out portion of the circumferential wall, thereby eliminating the housing-receiving width and the hood.

2. The lever-operative connector according to claim 1, wherein an interior of the circumferential wall is provided with a rib extending in a direction connecting the one opening to the other opening and not interfering with a rotation of the lever, and wherein the one connector housing is provided with a rib groove which is engageable with the rib.

3. The lever-operative connector in accordance with claim 1, wherein the one opening side of the circumferential wall is firstly passed through a panel so that the circumferential wall of the frame is coupled to the panel.

4. The lever-operative connector in accordance with claim 3, wherein the frame includes a plurality of protrusions adapted to abut an end face of the panel.

5. The lever-operative connector in accordance with claim 1, wherein each frame side wall is in an approximately trapezoidal shape of which length along a longitudinal axis of the circumferential wall is gradually greater as it is close to the other opening from the one opening.

6. A lever-operative connector, comprising:

a tube-shaped frame having a circumferential wall having one opening and a second opening at both ends, the tube-shaped frame further having first and second side walls, the first and second sidewalls defining first and second bearing holes, a lever rotatably coupled to an interior of the first and second sidewalls of the frame, the lever including first and second sidewalls, the first and second sidewalls of the lever having first and second supportive shafts adapted to engage with the first and second bearing holes, respectively, the support shafts entering into the bearing holes from the interior of the frame;

one connector housing having a follower, which is engageable with a cam portion of the lever, and being capable of being received inside the frame via a housing-receiving width communicating with the one opening; and a second connector housing received inside the frame via the second opening, and being engageable with the one connector housing, wherein the lever is rotated from the one opening side toward the second opening side so as to guide the follower along the cam portion, thereby allowing the one connector housing to be received inside the frame, wherein the frame has a cut out portion formed in a part of the circumferential wall and communicating with the one opening, wherein when the lever is rotated toward the one opening side, a part of a lever side wall is exposed from the interior of the circumferential wall so as to entirely fill the cut out portion of the circumferential wall, thereby forming, together with the frame, a hood having the housing-receiving width, and wherein when the lever is rotated toward the second opening side, the part of the lever side wall is received inside the circumferential wall so as to open the cut out portion of the circumferential wall, thereby eliminating the housing-receiving width and the hood.

7. The lever-operative connector in accordance with claim 6, wherein the first and second lever side walls have respective outer side faces, the first and second outer side surfaces being substantially coplanar with first and second outer side faces of the first and second frame side walls, respectively.

* * * * *